US011280145B2

(12) United States Patent
Toffolo

(10) Patent No.: US 11,280,145 B2
(45) Date of Patent: Mar. 22, 2022

(54) DRILLING APPARATUS AND METHOD FOR RELEASING DRILLING RODS STUCK IN SURROUNDING GROUND

(71) Applicant: ENI S.P.A., Rome (IT)

(72) Inventor: Gilberto Toffolo, Sandnes (NO)

(73) Assignee: ENI S.P.A., Rome (IT)

( * ) Notice: Subject to any disclaimer, the term of this patent is extended or adjusted under 35 U.S.C. 154(b) by 0 days.

(21) Appl. No.: 16/756,989

(22) PCT Filed: Oct. 17, 2018

(86) PCT No.: PCT/IB2018/058048
§ 371 (c)(1),
(2) Date: Apr. 17, 2020

(87) PCT Pub. No.: WO2019/077518
PCT Pub. Date: Apr. 25, 2019

(65) Prior Publication Data
US 2021/0123314 A1 Apr. 29, 2021

(30) Foreign Application Priority Data
Oct. 18, 2017 (IT) ..... 10 2017 000117866

(51) Int. Cl.
*E21B 31/00* (2006.01)
*E21B 47/00* (2012.01)

(52) U.S. Cl.
CPC ..... *E21B 31/005* (2013.01); *E21B 47/00* (2013.01)

(58) Field of Classification Search
CPC ..... E21B 31/005
See application file for complete search history.

(56) References Cited

U.S. PATENT DOCUMENTS 2,562,320 A 7/1951 Lowe
6,321,857 B1 * 11/2001 Eddison ..... E21B 17/1014 175/61
2005/0194183 A1 9/2005 Gleitman
2005/0194187 A1 * 9/2005 Gleitman ..... E21B 7/24 175/57
2009/0266612 A1 10/2009 Allahar

FOREIGN PATENT DOCUMENTS

WO 2013009312 A1 1/2013

OTHER PUBLICATIONS

International Search Report dated Jan. 25, 2019 for PCT application No. PCT/IB2018/058048.
Written Opinion dated Jan. 25, 2019 for PCT application No. PCT/IB2018/058048.

* cited by examiner

*Primary Examiner* — Robert E Fuller
(74) *Attorney, Agent, or Firm* — Ohlandt, Greeley, Ruggiero and Perle, LLP

(57) ABSTRACT

A drilling apparatus and a method for releasing rods stuck in surrounding ground use a torsional device for releasing the drilling assembly and induce centrifugal forced vibrations and bending vibrations in the drilling rods, facilitating the release from positions stuck inside the drilled hole. The apparatus allows the available power of the motor drilling device to be fully applied for generating periodic forced vibrations useful for detaching the drilling rods stuck in the surrounding ground.

16 Claims, 2 Drawing Sheets

DRILLING APPARATUS AND METHOD FOR RELEASING DRILLING RODS STUCK IN SURROUNDING GROUND

CROSS-REFERENCE TO RELATED APPLICATIONS

The present application claims priority based upon PCT/IB2018/058048, filed Oct. 17, 2018, which claims priority based on Italy Application No. 102017000117866, filed Oct. 18, 2017.

The present invention relates to a drilling apparatus and the related method for releasing drilling rods stuck in surrounding ground; the present invention applies to the process for realizing an extraction well adapted for the extraction of fluids from the subsurface, such as hydrocarbons.

The problems related to releasing drilling rods during the operations of drilling the hole of an extraction well are known and the phenomenon of drilling rods stuck inside the drilled hole is frequent and causes notable complications in the process of implementing an extraction well.

Different solutions are known for solving the problem of a stuck drilling assembly as one or more rods are stuck with respect to the surrounding ground, preventing the continuation of the drilling operations.

The solution mainly adopted for releasing a stuck drilling assembly envisages the use of a device called a jar in technical jargon, inserted in the drilling bottom hole assembly and normally positioned above drill collars assembly, therefore about 200 meters from the bit.

Once a rod is stuck in the surrounding ground, this device allows high intensity impulsive axial actions to be generated in the drilling assembly, with frequencies of about one blow per minute, with the aim of pulling the stuck drilling assembly and therefore releasing it.

Two types of jar devices are substantially known: the "fishing jar" and the "drilling jar". Whereas the fishing jar is not adapted to withstand the stresses that are established in the drilling assembly during normal drilling operations, the drilling jar is essentially a component of the drilling assembly that can operate during normal drilling operations.

Jars are mechanical or hydraulic operated devices that respectively use the energy stored by an elastic system (e.g. a series of springs) or the pressure energy of a hydraulic fluid for developing the impulsive force that characterizes them.

The action of the jar only allows the drilling assemblies to be released in a limited number of cases. One of the main limitations of the jar device consists of the fact that it generates very intense but impulsive axial forces, with a very short duration, in the order of a fraction of a second and therefore, also in the presence of high forces, the power that can be expressed for releasing the stuck drilling assembly is necessarily limited. The impossibility to axially move or rotate the stuck drilling assembly prevents mechanical energy in the traditional form used during drilling being brought to the bottom of the well.

A second problem associated with the use of the jar is that it induces a purely axial tensile state. In particular, in conditions of differential sticking of a drilling assembly, the axial actions are not the most effective solution for promoting the release of the stuck drilling rod as if the stuck part can be moved, it is pulled longitudinally along the hole but tends to remain stuck.

Recently developed systems are also known that apply vibrations to the surface or to the bottom of the drilling assembly so as to promote the release thereof.

Systems that apply vibrations represent interesting solutions, however they require time before being able to be used, while one of the key factors for the success of releasing stuck rods is represented by the timeliness of the intervention. In fact, the more time it passes from the sticking moment, the more the sticking itself will be consolidated, particularly for differential pressure.

The object of the present invention is to realize a device and a method that overcome the drawbacks of the prior art, allowing timely and effective intervention in situations of stuck rods of drilling assemblies in the drilling hole.

According to the present invention a drilling apparatus has been realized that allows a large quantity of power to be brought to the bottom of the well, releasing such power not only through the generation of impulsive axial actions but also by generating bending stresses applicable straight after a stuck drilling assembly condition has been recognized.

The subject matter of the present invention is therefore a drilling apparatus 100 for releasing rods stuck in surrounding ground comprising:

- a motor device 115 configured to generate torque;
- a drilling assembly 120, connected to the motor device 115, comprising a plurality of drilling rods 130 configuring a longitudinal axis A of the drilling assembly 120;
- a drilling bit 150 connected to the plurality of drilling rods 130;
- a torsional coupling device 140 of the drilling assembly 120, interposed between the drilling rods 130 in a predetermined position with respect to the bit 150 so as to divide the drilling assembly 120 into an upper and a lower part, configured to selectively disrupt the torque transmission between the upper and lower part of the drilling assembly 120;

characterized in that the drilling apparatus 100 comprises:

- a device 180 for generating forced vibrations due to centrifugal force orthogonal to the longitudinal axis A and rotating about the longitudinal axis A, the centrifugal-force vibration generator device 180 comprising a first body integral with the upper part and a second body integral with the lower part of the drilling assembly 120, said first and second body configuring a dynamically balanced system when the entire drilling assembly 130 rotates;

the drilling apparatus 100 being further characterized in that the drilling apparatus 120 can pass from a first configuration, in which the torsional coupling device 140 transmits torque motion allowing the rotation of the entire drilling assembly 120 and the centrifugal-force vibration generator device 180 does not produce effects being balanced in rotation with respect to the longitudinal axis A, to a second configuration in which the torsional coupling device 140 does not transmit torque motion allowing the rotation of the upper part of the drilling assembly 120 with respect to the lower part of the drilling assembly 120 and the centrifugal-force vibration generator device 180 is unbalanced during the rotation of the upper part generating a rotating centrifugal-force vibration orthogonal to the longitudinal axis A, able to establish a rotating bending stress regime in the lower part of the drilling assembly 120 in order to release the drilling rods 130 of the lower part of the drilling assembly 120 stuck inside a drilling well 100.

The subject matter of the present invention is also a method for releasing drilling rods stuck in surrounding ground as described below.

The characteristics and advantages of the present invention will appear clear from the following description of a non-limiting embodiment with reference to the appended figures of the drawings, wherein.

Figure 1:
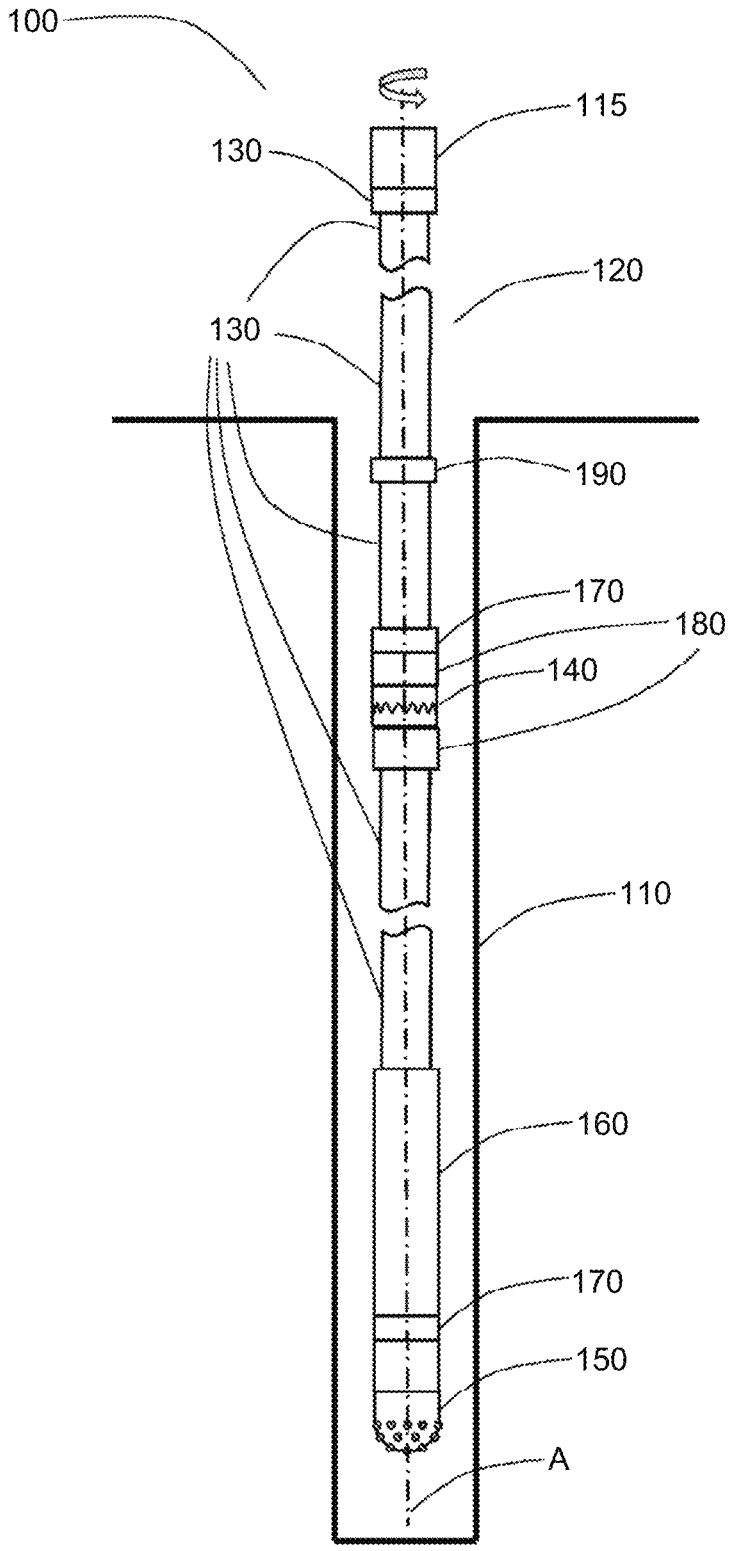
FIG. 1 is a schematic view of the drilling apparatus comprising the torsional coupling device, the drilling assembly and rods, the monitoring system and the centrifugal-force vibration generator device, with particulars and details omitted for reasons of clarity.

For the purpose of the present invention, the portion of drilling rods pertaining to the assembly that extend from a torsional coupling device towards the surface is defined as the upper part of the drilling assembly.

For the purpose of the present invention, the portion of drilling rods pertaining to the assembly that extend from a torsional coupling device towards the bottom of the well is defined as the lower part of the drilling assembly.

The present invention reduces one of the most frequent problems associated with drilling operations, that is the sticking of the drilling assembly; in the case of a stuck drilling assembly, the drilling work schedule is strongly penalized with a considerable increase in implementation times and costs. Very often the stuck part of the drilling assembly has to be left at the bottom of the well after succeeding in backing off the rest of the assembly itself from as far down in the well as possible.

There are different types of sticking of drilling assemblies but the most important and those that happen most frequently are sticking due to differential pressure i.e. due to the sticking of the drilling assembly in a surrounding zone with high permeability having lower pressure than the drilling mud and sticking due to a pack off, characterized by the collapse of a part of the formation surrounding the drilling assembly. In consideration of the high costs and low probability to release the stuck part of assembly, with successive attempts, in most cases it is preferred to abandon the affected part of the hole and, after closing it with a cement plug, perform a side track from the original hole and drill again the whole stretch of abandoned hole.

A distinctive element of the present invention is bringing towards the bottom of the well 110, as close as possible to the stuck drilling assembly 120, a larger amount of energy that can be used to release the portion of stuck rods 130. It has been observed that most sticking takes place prevalently in the stretch of drilling assembly that extends between the bit 150 and the top part of the drill collars 160; said portion of the assembly is normally about 200 meters long and a possible jar is usually positioned in this stretch of assembly. It has been noted that, advantageously, the centrifugal-force vibration generator device 180 can preferably be installed in the portion of drilling assembly 120 that extends between the bit 150 and the top part of the drill collars 160.

With reference to FIG. 1, a drilling apparatus 100 is illustrated wherein a drilling assembly 120, comprising a plurality of drilling rods 130, is connected to a motor device 115 adapted to make the drillstring 120 rotate; the drilling assembly 120 further comprises a torsional coupling device 140 that can be activated so as to selectively disrupt the torque transmission to the lower part of the drilling assembly 120, leaving the upper part of the drilling assembly 120 free to rotate under the action of the motor device 115. The drilling apparatus 100 is also provided with a bit 150. The drilling assembly 120 comprises a centrifugal-force vibration generator device 180 which, under certain conditions of use, establishes in the drilling assembly 120 a vibrational regime with induced displacements on orthogonal planes to the longitudinal axis A of the assembly itself. In particular, the drilling apparatus 120 can pass from a first configuration in which the torsional coupling device 140 transmits torque motion allowing the rotation of the entire drilling assembly 120 and the centrifugal-force vibration generator device 180 does not produce effects being balanced in rotation with respect to the longitudinal axis A, to a second configuration in which the torsional coupling device 140 does not transmit torque motion allowing the rotation of the upper part of the drilling assembly 120 with respect to the lower part of the drilling assembly 120 and the centrifugal-force vibration generator device 180 is unbalanced during rotation of the upper part generating a rotating centrifugal-force vibration orthogonal to the longitudinal axis A, able to establish a rotating bending stress condition in the lower part of the drilling assembly 120 in order to release the drilling rods 130 of the lower part of the drilling assembly 120 stuck inside a drilling well 110.

With the solution according to the present invention, once the detachment has been performed, the drilling assembly 120 can be recovered. The possibility to rotate the upper part of the drilling assembly 120 that is not stuck, while the lower part of the same assembly is stuck, allows all the available power of the motor device 115 to be used which, through the centrifugal-force vibration generator device 180, induces strains of a proportional size and frequency to the imbalance of masses of the centrifugal-force vibration generator device 180 and to the number of revolutions of the motor device 115.

The energy thus available close to the sticking point can be, in the described configuration, an order of magnitude higher than that of a jar or a conventional vibration system that is powered by a hydraulic motor.

A further advantageous aspect of the present invention, unlike what is possible with known technologies, consists of the fact that the drilling operators have the possibility to intervene more directly to release the drilling assembly 120 and with much lower intervention times than normally envisaged. The operator is usually forced to perform long static applications of torsions and tractions on the drilling assembly 120 at the resistance limit of the rods themselves for attempting to release the stuck drilling rods 130; through the present invention, by rotating the upper part of the drilling assembly 130, torsionally released from the lower part by means of the torsional coupling device 140, the operators are able to generate rotating bending stresses with a high energy content available close to the sticking point, optimizing the frequency and intensity of the centrifugal-force vibration according to the type of grip.

The drilling apparatus 100 comprises two essential elements. The first element is a torsional coupling device 140 that allows the upper part of the drilling assembly 120 to be torsionally released from the lower stuck one; the second element is a centrifugal-force vibration generator device 180 activated by the rotation of the upper part of the drilling assembly 120 free to turn, therefore from the motor device 115.

Torsional coupling devices 140 are known in themselves and allow two parts of the drilling assembly 120 to be torsionally disconnected. The main use is that of reducing friction during the descent of liners or casings performed with long portion of drilling rods.

When the entire system of casings and drilling rods is not able to rotate because the torsions caused by the casings would be too high, rods are torsionally disconnect for reducing their friction and discharging more weight on the casings that could have trouble descending into the hole, especially in the case of horizontal holes or in the case of wells with complex geometry. Torsional coupling devices 140 allow the interruption and subsequent resumption of the transmission of torque along the drilling assembly 120 an unlimited number of times, maintaining the ability to transmit axial and cutting actions and bending moments. Torsional coupling devices 140 may be mechanically or hydraulically activated.

The centrifugal-force vibration generator device 180 comprises a first body integral (i.e. moving together) with the upper part and a second body integral with the lower part of the drilling assembly 120; the first body, exploiting the rotation of the upper part of the drilling assembly 120 when the torsional coupling device 140 does not transmit torque to the lower stuck part of the drilling assembly 120, causes rotating centrifugal forces about the longitudinal axis A of the drilling battery due to eccentric masses present in the first body. Said centrifugal forces produce a rotating bending moment whose intensity depends on the magnitude of the eccentric masses and the rotation speed of the drilling rods 130.

The first and the second body of the centrifugal-force vibration generator device 180 are therefore provided with eccentric masses advantageously arranged so that, when the torsional coupling device 140 transmits torque motion and the entire drilling assembly 120 rotates, the result of the centrifugal forces generated by the rotation of the eccentric masses is null, as the bending moments contained in planes containing the longitudinal axis A, deriving from such forces, are also null. When the torsional coupling device 140 interrupts the transmission of torque motion and only the upper part of the drilling assembly 120 rotates while the lower part is stuck in the well, only the first body of the centrifugal-force vibration generator device rotates, realizing a dynamically unbalanced system that produces a rotating centrifugal-force vibration orthogonal to the longitudinal axis A adapted to establish a rotating bending stress regime in the lower part of the drilling assembly 120 in order to release the drilling rods 130 of the lower part of the drilling assembly 120 stuck inside a drilling well 100.

Figure 2:
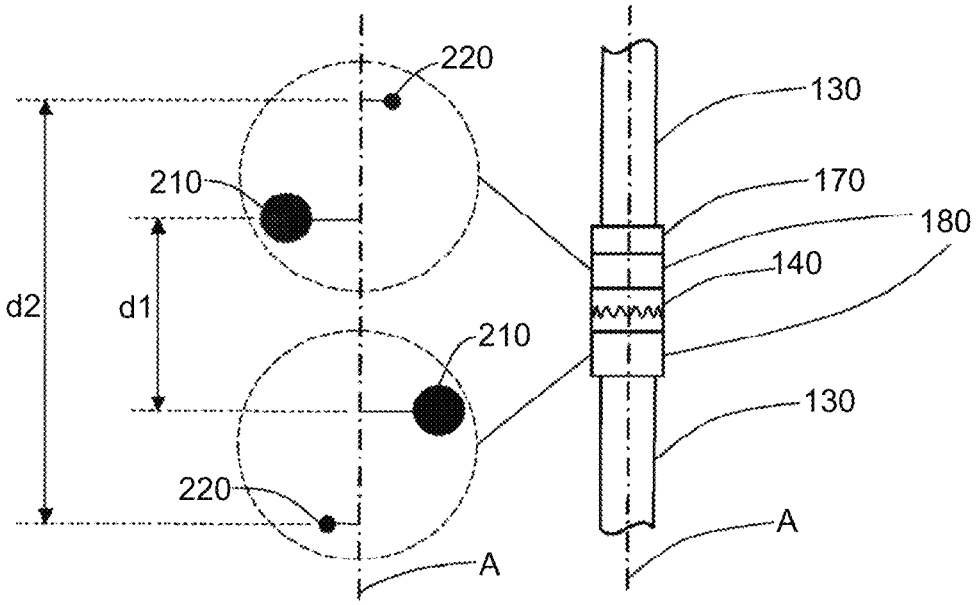
FIG. 2 is a schematic view of the centrifugal-force vibration generator device with details related to the arrangement of the primary and secondary eccentric masses, with particulars and details omitted for reasons of clarity.

In a preferred configuration of the drilling apparatus 100, the first body and the second body of the centrifugal-force vibration generator device 180, respectively integral with the upper and lower part of the drilling battery 120, each comprise at least one primary eccentric mass 210 and one secondary eccentric mass 220, said eccentric masses being arranged in a dynamically balanced manner in the first configuration of the drilling apparatus 100. In this way it is guaranteed that, when the torsional coupling device 140 transmits torque motion and the entire drilling assembly 120 rotates, the result of the centrifugal forces generated by the rotation of the eccentric masses is null, as the bending moments in planes containing the longitudinal axis A, deriving from such forces, are also null. The primary eccentric masses 210 of the first and of the second body are arranged in such a way as to cancel out the result of the respective centrifugal components when the entire drilling assembly 120 is rotating. As illustrated in FIG. 2 however, the primary eccentric masses 210 previously described generate a rotating bending moment that is advantageously cancelled out through the appropriate positioning of the secondary eccentric masses 220; for that purpose, the secondary eccentric masses 220 of the first and of the second body of the centrifugal-force vibration generator device 180 are arranged in such a way as to cancel out the result of the respective centrifugal components when the entire drilling assembly 120 is rotating, creating a further rotating bending moment that cancels out the contribution of the bending moment generated by the rotating primary eccentric masses.

The assembly of primary 210 and secondary 220 eccentric masses guarantees that, during the rotation of the entire drilling assembly 120, the result of the centrifugal forces that can be attributed to said masses is null and the result of the bending moments generated by said centrifugal forces is null.

In a further preferred configuration of the drilling apparatus 100, the eccentric masses 210, 220 are obtained by selectively removing material from the first and second bodies of the centrifugal-force vibration generator device 180. In this way it is possible to create mass imbalances in the drilling assembly 120 simply and without affecting the dimensions of the components.

In a further preferred configuration, the drilling apparatus 100, as described in any one of the preceding embodiments, comprises a jar, placed between the drilling rods 130, at a predetermined position with respect to the bit 150, independent from the centrifugal-force vibration generator device 180, configured to transmit axial actions at the lower part of the drilling assembly 120, said axial actions being selectively combined with the rotating bending stress regime induced by the centrifugal-force vibration generator device 180 in order to release the drilling rods 130 stuck inside a drilling well 100. The combination of centrifugal rotating lateral forces, meaning forces in an orthogonal direction to the longitudinal axis A, rotating bending moments and axial actions along the drilling assembly 120, represents a particularly effective system for releasing stuck drilling rods 130. The operator can therefore decide in which sequence and with which intensity to apply all the forced vibrations that can be expressed by the system as configured above in order to reach the objective of releasing stuck rods.

In order to make the drilling apparatus 100 as previously described more efficient, in any one of its embodiments, it is particularly advantageous to equip the drilling apparatus 100 with a monitoring system that can acquire data on the operation of the apparatus such as, for example, the number of revolutions of the motor device 115, the entity of the displacements and accelerations of the drilling assembly 120, the speeds and accelerations of the bit according to a Cartesian triad with an axis coinciding with the longitudinal axis of the drilling assembly 120.

In a further preferred configuration, the drilling apparatus 100, as described in any one of the preceding embodiments, comprises a monitoring system 170 configured to measure vibrations and identify the natural frequencies of the drilling assembly 120.

The monitoring system 170 is known in itself. The monitoring can take place with the application of sensors along the drilling assembly 120 at the bottom, or in proximity to the centrifugal-force vibration generator device 180, or at the surface with sensors appropriately coupled to the rods, or in any combination of arrangements of the sensors previously described. The sensors not installed at the surface are configured to transmit data in real time through a telemetry system that can be of the wired or wireless type. In order to acquire data continuously and in real time on the vibrations of the drilling assembly 120 both surface and well-bottom systems are suitable. The classic surface data transmission system comprises the so-called "Mud Pulse" telemetry, but which has a limit on the data transmission speed. Should a faster data transmission system be required, it is possible to use "wired" drilling rods which, containing an electrical cable, can convey information at a higher speed compared to the known wireless systems. The monitoring system sensors 170, able to measure the triaxial vibrations of the drilling assembly 120, are known in themselves and commercially available.

The subject matter of the present invention is also a method for releasing rods stuck in surrounding ground comprising the steps of:

providing a drilling apparatus 100 according to any one of the embodiments previously described;

tripping in the drilling apparatus 100 into a drilling well 110;

selectively deactivating the torsional coupling device 140 so that it does not transmit torque motion;

generating centrifugal forced vibrations orthogonal to the longitudinal axis A and rotating about the longitudinal axis A by establishing a rotating bending stress regime in the lower part of the drilling assembly 120 in order to release the drilling rods of the lower part of the drilling assembly 120 stuck inside a drilling well 100.

It has also been noted that, depending on the entity and frequency of the centrifugal forced vibrations generated and applied to the drilling assembly 120, the assembly can be excited in a resonance regime; since in a mechanical system, for every individual mode of vibration nodal points are observed at null displacement and points in which the displacements are maximum. By monitoring the trend of the vibrations of the drilling assembly 120, it is possible to identify resonant oscillation regimes, maximizing the vibrational effect for releasing the stuck rods. In particular, the drilling apparatus 100 is characterized by natural vibration frequencies that depend on the geometry of the tubular materials or rods 130, on the geometry of the hole of the drilling well 110, but also on the sticking point. By applying periodic forced vibrations with frequencies around the natural frequencies of the system, operations are performed in the resonance regime thus amplifying the displacement effects in the sticking point. However, it is not initially possible to know the location of sticking point in which the drilling assembly 120 is stuck and therefore the distance between the centrifugal-force vibration generator device and the sticking point of the assembly itself is not known. Therefore the natural frequencies of the drilling assembly 120 stuck in the well are not known a priori.

Preferably, the method according to the invention previously described comprises the step of conducting a step of exploring the natural frequencies of the stuck drilling assembly 120 in order to establish which natural frequencies to exert through the forces generated by means of the centrifugal-force vibration generator device 180. Since the centrifugal forced vibrations are generated through the rotation of the drilling rods, connected to the motor device 115, whose number of revolutions per minute usually ranges from 0 to about 120 revolutions per minute, it is possible to gradually change the rotation speed of the motor device and analyze, through the monitoring system 170, the oscillation magnitudes caused in the drilling assembly 120. When an oscillation magnitude peak is observed, it means that the system is close to a natural frequency. Once the number of revolutions per minute associated with a resonance frequency of interest has been identified, it is advantageous to operate at that determined number of revolutions per minute in order to maximize the induced vibrational effects and release the drilling assembly 120. The identification of the natural frequencies of the drilling assembly 120 further allows the position of the sticking point to be estimated as the natural frequencies are also a function of the free inflexion length of the assembly. By inducing a vibrational regime adapted to excite a characteristic frequency, through the monitoring system 170, it is possible to continuously monitor in real time the modification of the sticking condition and the gradual release of the drilling assembly 120.

In a preferred configuration, the method according to the invention previously described further comprises the steps of:

monitoring the vibrations of the drilling assembly 120, identifying a natural frequency of the drilling assembly 120 by gradually modifying the rotation speed of the motor device 115, modifying the rotation regime of the upper part of the drilling assembly 120 to generate centrifugal forced vibrations 180 orthogonal to the longitudinal axis A and rotating about the longitudinal axis A to excite a natural frequency of the drilling assembly 120.

During the step of generating centrifugal forced vibrations orthogonal to the longitudinal axis A and rotating about the longitudinal axis A, it is particularly effective to exert, according to the control and discretion of the operator, traction and/or compression forces on the drilling assembly 120.

In a further preferred configuration, the method according to the invention as previously described in any one of its preferred embodiments further comprises the steps of:

selectively applying traction forces to the drilling assembly 120, selectively applying compression forces to the drilling assembly 120.

It has also been observed that it is advantageous to combine centrifugal forced vibrations both with traction and/or compression forces and with further impulsive axial stresses such as those generated by a jar. The selective application of the forced vibrations previously described in any combination thereof therefore represents a preferred implementation of the method described above.

In a further preferred embodiment, the method according to the invention as previously described in any one of its preferred embodiments further comprises the step of selectively exerting impulsive axial stresses on the drilling assembly 120 through a jar installed along the assembly.

In a further preferred embodiment, the method according to the invention as previously described in any one of its preferred embodiments further comprises the step of selectively exerting torsional stresses in the lower part of the stuck drilling assembly 120.

The application of torsional actions on the drilling assembly 120, combined with stresses of an axial and/or bending nature according to logics established by the operator, allows the possibility of releasing the stuck drilling rods to be increased.

The invention as previously described in its various embodiments can also be applied to the operations of lowering casings or liners into wells; in these situations, for similarity, the drilling rods are replaced by casings or liners. The lowering of the casings and lower completion components can pose significant risks. Said casings and components in most cases cannot be rotated and therefore, are either simply lowered into the hole, or otherwise can interrupt the descent at unpredictable points. The difficulty in lowering them can be caused by various reasons such as a particularly long hole, highly tortuous holes, incorrect centering, enlarged clay particles or an unstable hole or by a combination of one or more of these factors. The frequency of occurrence of these phenomena can be assimilated to that of stuck drilling assemblies.

The possibility of establishing a vibrational regime in the casing can allow friction peaks to be overcome, preventing irreversible locking in the hole.

The drilling apparatus 100 and the method for releasing drilling rods 130 stuck in surrounding ground according to the present invention thus conceived are subject in any case to numerous modifications and variants, all falling within the same inventive concept; furthermore all the details can be replaced by technically equivalent elements.

The materials used, as well as the shapes and dimensions, may in practice be of any type according to the technical requirements.

The protective scope of the invention is therefore defined by the appended claims.

The invention claimed is:

1. A drilling apparatus for releasing rods stuck in surrounding ground comprising:

a motor device configured to generate torque;

a drilling assembly connected to the motor device, comprising a plurality of drilling rods defining a longitudinal axis (A) of the drilling assembly;

a drilling bit connected to the plurality of drilling rods;

a torsional coupling device of the drilling assembly, positioned between the drilling rods at a predetermined position with respect to the bit so as to divide the drilling assembly into an upper and a lower part, configured to selectively disrupt the torque transmission between the upper and lower part of the drilling assembly;

wherein the drilling apparatus comprises:

a device for generating forced vibrations due to centrifugal force orthogonal to the longitudinal axis (A) and rotating around the longitudinal axis (A), the centrifugal-force vibration generator device comprising a first body integral with the upper part and a second body integral with the lower part of the drilling assembly, said first and second bodies configuring a dynamically balanced system when the upper part and the lower par rotate together;

wherein the drilling assembly has a first configuration and a second configuration;

wherein in the first configuration the torsional coupling device transmits torque motion allowing the upper part and the lower part to rotate together, and the centrifugal-force vibration generator device does not produce vibration effects, the centrifugal-force vibration generator device being balanced in rotation with respect to the longitudinal axis (A); and wherein in the second configuration the torsional coupling device does not transmit torque motion allowing rotation of the upper part of the drilling assembly with respect to the lower part of the drilling assembly and the centrifugal-force vibration generator device is unbalanced during the rotation of the upper part, thereby generating a rotating centrifugal-force vibration orthogonal to the longitudinal axis (A), adapted to establish a rotating bending stress regime in the lower part of the drilling assembly in order to release the drilling rods of the lower part of the drilling assembly stuck inside a drilling well.

2. The drilling apparatus according to claim 1, wherein the first body and the second body of the centrifugal-force vibration generator device, respectively integral with the upper and lower part of the drilling assembly, each comprise at least one primary eccentric mass and one secondary eccentric mass, said eccentric masses being arranged in a dynamically balanced manner in the first configuration of the drilling apparatus.

3. The drilling apparatus according to claim 2, wherein the eccentric masses are obtained by selectively removing material from the first and second bodies of the centrifugal-force vibration generator device.

4. The drilling apparatus according to claim 1, further comprising a jar placed between the drilling rods at a predetermined position with respect to the bit, independent from the centrifugal-force vibration generator device, configured to transmit axial actions at the lower part of the drilling assembly, said axial actions being selectively combined with the rotating bending stress regime induced by the centrifugal-force vibration generator device in order to release the drilling rods stuck inside the drilling well.

5. The drilling apparatus according to claim 1, comprising a monitoring system configured to measure vibrations and identify the natural frequencies of the drilling assembly.

6. A method for releasing rods stuck in surrounding ground comprising the steps of:

providing a drilling apparatus according to claim 1;

lowering the drilling apparatus into the drilling well;

selectively deactivating the torsional coupling device (140) so that it does not transmit torque motion;

generating centrifugal forced vibrations orthogonal to the longitudinal axis (A) and rotating about the longitudinal axis (A) by establishing a rotating bending stress regime in the lower part of the drilling assembly in order to release the drilling rods of the lower part of the drilling assembly stuck inside the drilling well.

7. The method according to claim 6, further comprising the steps of:

monitoring the vibrations of the drilling assembly, identifying a natural frequency of the drilling assembly by gradually modifying the rotation speed of the motor device, modifying the rotation regime of the upper part of the drilling assembly to generate centrifugal forced vibrations orthogonal to the longitudinal axis (A) and rotating about the longitudinal axis (A) to excite a natural frequency of the drilling assembly.

8. The method according to claim 7, further comprising the steps of:

selectively applying traction forces to the drilling assembly, selectively applying compression forces to the drilling assembly.

9. The method according to claim 7, further comprising the step of selectively exercising impulsive axial stresses on the drilling assembly by means of a jar installed along the assembly.

10. The method according to claim 7, further comprising the step of selectively applying torsional stresses at the lower part of the stuck drilling assembly.

11. The method according to claim 6, further comprising the steps of:

selectively applying traction forces to the drilling assembly, selectively applying compression forces to the drilling assembly.

12. The method according to claim 11, further comprising the step of selectively exercising impulsive axial stresses on the drilling assembly by means of a jar installed along the assembly.

13. The method according to claim 11, further comprising the step of selectively applying torsional stresses at the lower part of the stuck drilling assembly.

14. The method according to claim 6, further comprising the step of selectively exercising impulsive axial stresses on the drilling assembly by means of a jar installed along the assembly.

15. The method according to claim 14, further comprising the step of selectively applying torsional stresses at the lower part of the stuck drilling assembly.

16. The method according to claim 6 further comprising the step of selectively applying torsional stresses at the lower part of the stuck drilling assembly.

* * * * *